US008256066B2

(12) United States Patent
Bubnov et al.

(10) Patent No.: US 8,256,066 B2
(45) Date of Patent: Sep. 4, 2012

(54) METHOD FOR PROCESSING BAST-FIBER MATERIALS

(75) Inventors: Grigoriy Georgievich Bubnov, Moscow (RU); Victor Nikolaevich Zakharov, Moscow (RU); Fedor Vladimirovich Zubov, Tver (RU); Alexandre Viacheslavovich Semenov, Moscow (RU)

(73) Assignee: Good Wave Technologies Limited, Limassol (CY)

( * ) Notice: Subject to any disclaimer, the term of this patent is extended or adjusted under 35 U.S.C. 154(b) by 20 days.

(21) Appl. No.: 12/997,977

(22) PCT Filed: Aug. 14, 2009

(86) PCT No.: PCT/RU2009/000407

§ 371 (c)(1),
(2), (4) Date: Dec. 14, 2010

(87) PCT Pub. No.: WO2009/157814

PCT Pub. Date: Dec. 30, 2009

(65) Prior Publication Data

US 2011/0099766 A1 May 5, 2011

(30) Foreign Application Priority Data

Jun. 17, 2008 (RU) ..... 2008123452

(51) Int. Cl.
*D01B 1/00* (2006.01)

(52) U.S. Cl. ..... 19/7; 19/5 A

(58) Field of Classification Search ..... 19/5 A, 19/5 R, 7, 9; 162/20, 50, 98
See application file for complete search history.

(56) References Cited

U.S. PATENT DOCUMENTS

| | | | | |
|---|---|---|---|---|
| 5,232,779 | A * | 8/1993 | Spehner | 428/379 |
| 6,767,634 | B2 * | 7/2004 | Krishnaswamy | 428/364 |
| 2003/0065059 | A1 * | 4/2003 | Krishnaswamy | 524/1 |

FOREIGN PATENT DOCUMENTS

| | | |
|---|---|---|
| JP | 2003253553 | 9/2003 |
| RU | 2119559 | 9/1998 |
| RU | 2246564 | 2/2005 |
| RU | 2280720 | 7/2006 |
| WO | 2006073330 | 7/2006 |

* cited by examiner

*Primary Examiner* — Shaun R Hurley
(74) *Attorney, Agent, or Firm* — Bachman & LaPointe, P.C.

(57) ABSTRACT

A method for processing bast-fiber materials involving loosening a material, placing said material in an aqueous medium, hydrodynamically processing material successively in two modes: first, in a continuous mode by performing a hydrodynamic wave field action, and then in a pulsed mode by performing a shock-wave action, wherein the pressure amplitude of the positive wave phase in the continuous mode is less than the pressure amplitude of the positive wave phase in the pulsed mode, and removing the material from the aqueous medium. It is possible by the method to produce a high quality cottonine, the linear density of which is equal to or less than 0.3 Tex with the optimal energy consumption of the production process.

8 Claims, 1 Drawing Sheet

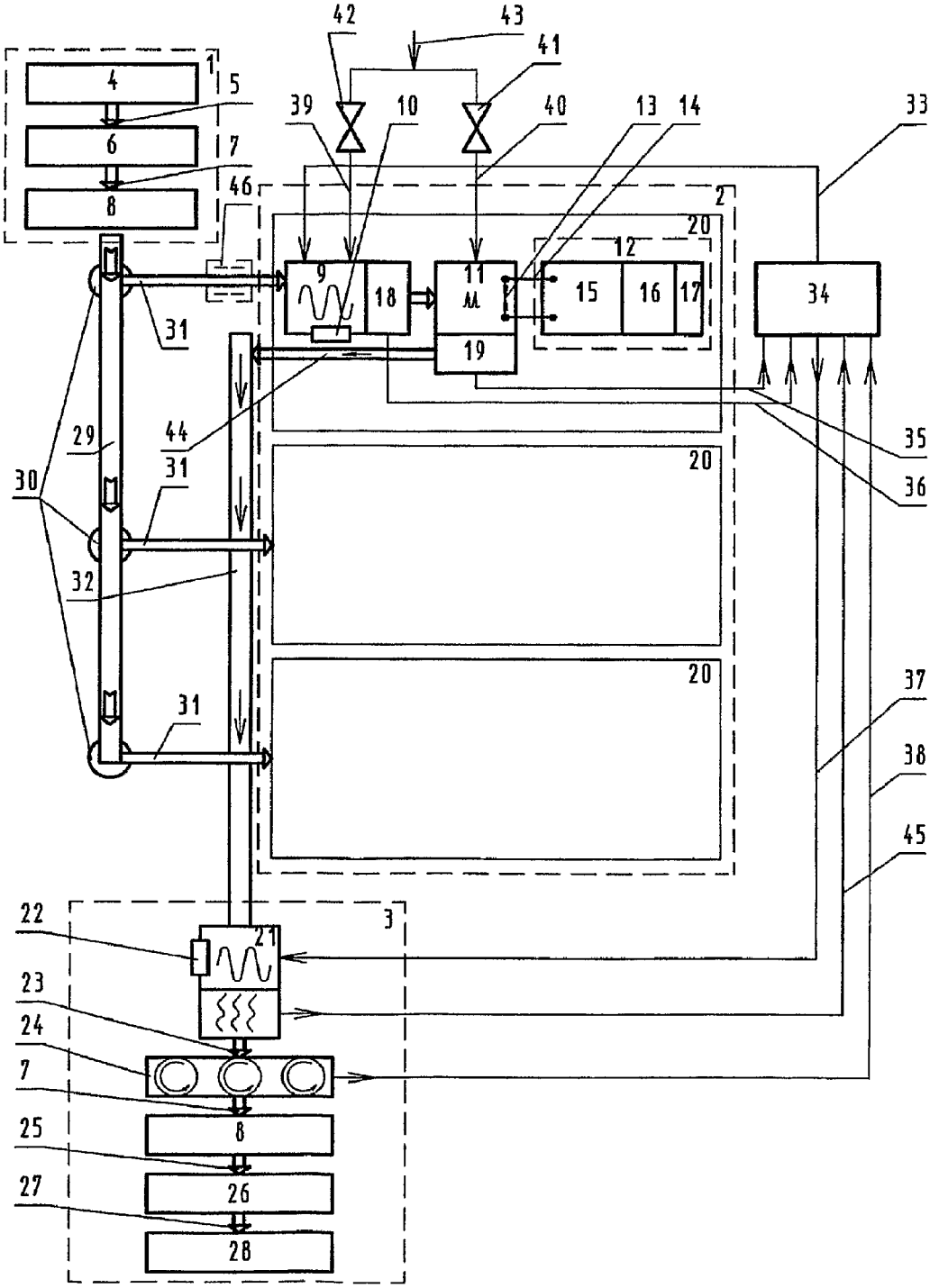
42
43
41
1
4
5
6
7
8
39
10
40
13
14
33
46
2
20
12
9
18
11
15
16
17
34
31
19
29
44
35
30
31
36
20
32
20
37
31
38
45
22
3
21
23
24
7
8
25
26
27
28

METHOD FOR PROCESSING BAST-FIBER MATERIALS

TECHNICAL FIELD TO WHICH THE INVENTION RELATES

The invention relates to the textile industry, particularly to methods for processing bast-fibre materials, for instance, fibres of flax, hemp, nettle, jute, and others.

PRIOR ART

A method for processing bast-fibre materials is known (RU 2280720, Int. Class D01B1/10, D01G21/00, published Jul. 27, 2006) involving loosening the material, placing it in an aqueous medium, hydrodynamically processing the material and subsequently removing the processed material from the aqueous medium, wherein the hydrodynamic impact on the material is performed in a pulsed mode from the source of electropulse (electrohydraulic) discharge in liquid to obtain cottonine.

The shortcoming of the known method, in which the cottonizing is performed directly by an electrohydraulic method, is the relatively low efficiency of the processing, which leads to an increase in the consumption of energy for the processing, the latter being directly connected to the number of delivered discharges from the electropulse impact source.

The most pertinent to the suggested method with respect to the technical content and the result obtained is a method for processing bast-fibre materials (flax fibre) (RU 2246564, Int. Class D01B1/42, D06B3/00, published Feb. 20, 2005) involving loosening the material, placing it in an aqueous medium, hydrodynamically processing the aqueous mixture of the material and removing the latter from the aqueous medium, wherein the hydrodynamic processing is performed in a pulsed mode by means of spark discharge in liquid using hydrodynamic components of said discharge: a shock wave, ultrasound. To increase the discharge efficiency, the method uses a washing liquid up to the processing and a wetting washing liquid to decrease the specific conductivity of the aqueous medium when performing the discharges.

A shortcoming of the method is that the hydrodynamic shock-wave impact is performed from one kind of impact source in a kind of electropulsed discharge in liquid.

A considerable amount of energy is spent in the initial phase of the hydrodynamic processing on the destruction of the interior part (the ligneous one in the shape of shoves) as well as the exterior part (outer skin, cuticle, bark) of the elements of the stem, and only thereafter is the cottonizing (the separation of fibres connected by pectin) performed directly. Thus the energy of the shock wave impact is spent directly on the cottonization only in the last processing phase, and this has an influence on the quality of the cottonine.

Moreover in the electropulsed breakdown in the "water/fibre" mixture after the channel phase of the breakdown the following basic factors have an influence on the mixture, which are caused by the expanding vapour-gas bubble: the hydraulic current and the shock wave disturbance, while the formation of a shock wave characterized of the electrohydraulic effect is difficult in the "water/fibre" mixture with a fibre density of ~1.5 g/cm$^3$.

As a consequence, the pulse disturbance (in the form of an averaging between the shock wave and the ultrasound) spreads in the entire mixture, with an amplitude of the positive part of the wave (the compression zone) bigger than the amplitude of the negative part of the wave (the evacuation zone).

In accordance with the nature of the electropulse impact, the basic element in cottonizing is the short-wave pulse impact, which is the most effective for processing the fibre part of the short flax fibre in particular. In the method for hydrodynamic processing disclosed in RU 2246564, the elements of the fibre whose constituent parts have different dimensions are processed by one and the same electrohydraulic (electropulse) impact, which is also an essential shortcoming of the method.

DISCLOSURE OF THE INVENTION

The technical result of the method according to the invention is an increase of the quality with a simultaneous decrease of the energy consumption of the cottonizing process (that is, bringing the fibre into a cotton-like state) of the bast-fibre material, an increase of the processing efficiency and, consequently, of the productivity of the process.

This technical result is achieved thus: The method for processing bast-fibre materials includes performing a loosening of the material, placing it in an aqueous medium, hydrodynamically processing the "water/fibre" mixture, removing the processed fibre from the aqueous medium, wherein according to the present invention the hydrodynamic processing is performed successively in two modes: first, in a continuous mode by the impact of a hydrodynamic wave field, and then in a pulsed mode by a shock wave impact. These modes are performed with different pressure amplitudes, namely, the pressure amplitude of the positive phase of the wave in the continuous mode is smaller than the pressure amplitude of the positive phase of the wave in the pulsed mode.

The duration of the positive phase of the wave in the continuous mode can be longer than the duration of the positive phase of the wave in the pulsed mode.

In the continuous mode the hydrodynamic processing can be performed in a centimeter wavelength range, while in the pulsed mode it can be performed in a millimeter wavelength range.

The hydrodynamic processing in the continuous mode can be performed using an ultrasound source, while in the pulsed mode it can be performed using a source of electropulse discharge in liquid.

The hydrodynamic processing in the continuous and pulsed modes can be performed in different aqueous media.

After the hydrodynamic processing in the pulsed mode using the source of electropulse discharge in liquid, an additional processing can be performed in the continuous mode using the ultrasound source.

Moreover, between loosening the material and placing it in the aqueous medium the material can be processed with UHF radiation. The processing with UHF radiation is performed in the continuous mode in a frequency range between 3 and 30 GHz.

The sequence of the hydrodynamic processing process using different kinds of sources depends on the particularities of the physics of the hydrodynamic impact with different parameters on the processing medium in the form of a heterogenous "water/fibre" mixture as well as on the difference in efficiency of the impact depending on the place of arrangement and the characterisations of the impact source. Due to the use of different kinds of hydrodynamic sources, an effective processing result can be obtained by varying either the places (the amount) of the impact or the wave characterisations of the hydrodynamic load.

Essentially, the initial stage of the hydrodynamic processing has the function of wetting the fibre while simultaneously separating the dissolved part of the fibre, cleansing it of impurities (salts, residual soil and the like), cleansing it of unnecessary fibre elements (shove) and weakening the bonds preventing an acceleration of the cottonizing process (cuticles, outer skin, lignin and pectin-containing bonds). This stage of the cottonizing requires a certain amount of time (usually 3-8 minutes) and is accelerated significantly (1.5-2 times) by the hydrodynamic wave impact.

The continuous mode of hydrodynamic processing by hydrodynamic wave impact is performed before the pulsed mode of hydrodynamic processing by shock wave impact particularly to increase the efficiency of the separation of the heterogenous mass, prioritising the impact on the ligneous constituent of the bast-fibre material, since the fibre elements "largest" in size have the lowest stability (in terms of destructibility) against impacts of the "+" and "−" type (referring to the compression and expansion amplitudes of the waves) without an interval cycle characteristic of a pulsed hydrodynamic impact.

The pressure amplitude of the positive phase of the wave in the continuous mode is chosen smaller than the pressure amplitude of the wave in the pulsed mode, to take into account the principles of "dimension" and "non-traumatic" in the presence of a phenomenon characteristic only for bast-fibre materials (for instance flax fibres) which lies in the increase of their strength characteristics (~by 40%) in a wet state compared to dry flax fibres. For the separation of the fibre elements with large dimensions, the required pressure amplitude of the fibres must be smaller than for processing fibre elements with smaller dimensions. Thus the principle of selectivity of the impact with respect to the amplitude pressure for ligneous and fibrous parts of the fascicle of flax fibres is implemented.

Moreover, in this approach of the "non-traumatic" principle (in the wet state of the fibres) with respect to the fibres of the fascicle is implemented in different pressures in the continuous and pulsed impact modes. Apart from this, the number of cycles performing the negative phase (many times higher in number in the continuous mode than in the pulsed mode) of the wave impact facilitates a weakening of the (principally pectin-containing) bonds between the elementary fibres of the fibrous part of the fascicle. For this very reason, for an effective cottonisation process (the greater the separation of elementary fibres from the fascicle, the higher the performance quality of the cottonizing process) the amplitude of the positive pressure phase in the pulsed mode exceeds (to an essential degree) the impact amplitude in the continuous mode. In the pulsed mode the hydrodynamic impact of the of the positive amplitude reaches values of 150-250 MPa, and in the continuous mode it reaches values of 8-12 MPa.

The duration of the positive phase of the wave in the continuous mode is chosen longer than the duration of the positive phase of the wave in the pulsed mode, to take into account the dimensions of the parts of the material to be processed, since in the first stage of cottonizing elements with larger dimensions are "removed" from the mixture than in the second (final) stage of cottonizing.

The choice of this difference in the duration of the waves fully depends on the calculation of the difference of the dimensional factors of the fibrous part (10-25 μm for an elementary fibre) and the residues of ligneous constituent of the stem (0.7-1.3 mm for a stem thickness of 1-2 mm).

In the continuous mode the hydrodynamic processing is performed in a centimeter range of the waves, while in the pulsed mode it is performed in a millimeter wavelength range, so as to take into account the influence of longitudinal and particularly of transverse waves, which propagate along the fascicle.

Transverse waves do not propagate in water, but in hydrodynamic processing these waves are created in the elements of the material to be processed. Since the average length of the elementary fibres is ~30 mm, for an effective weakening of the bonds (and consequently a separation of the fibres) a transverse wave in the millimeter range is required, while for the destruction of the significantly larger residues of shove a transverse and a longitudinal wave in the centimeter range are required. Thus for instance, when wave undulations are caused in the aqueous medium with a length of the longitudinal wave of ~6.8 cm, the length of the transverse wave in the fascicle will be of the order of 3.2 cm, and in a pulsed shock-wave load with a wavelength of ~4.5 mm (in water), transverse waves are created in the fibre with a wavelength of ~2 mm. With respect to the length dimensions of the fibre, such a wavelength is best suited for weakening the bonds between the fibres. The fibre is not only subjected to the impact of a longitudinal wave (amplitude load) but also of a transverse wave (wave load).

Moreover the wavelength of 2 mm is chosen so as to take into account the necessity of processing fibres with minimal longitudinal dimensions (for instance a minimal longitudinal dimension of an elementary flax fibre is 2-2.5 mm).

Because the hydrodynamic processing in the continuous mode is performed using an ultrasound source, and in the pulsed mode it is performed using a source of electropulse discharge in liquid, it becomes possible to significantly increase the efficiency of the processing process by a "division of labour": ultrasound for removing salts, shove, grease, cuticles and the like, and for the beginning of the separation of the fibres, and also for accelerating the process of wetting, removing the soluble part of the fibres, and electropulse discharge in liquid for the cottonizing, that is, the further weakening of the pectin-containing as well as the mechanical bonds between the elementary fibres in the fascicle.

The ultrasound impact also prepares the fibre for an effective electropulse impact, significantly reducing the specific conductivity of the "water/fibre" mixture, also by removing the physically bound air from the fibrous mass.

Due to the additional processing of the material using an ultrasound source, which is performed in the continuous mode after the processing using the source of electropulse discharge in liquid, an additional cleansing of the fibrous mass from products of electrode erosion as well as an orientation of the elementary fibres for their optimal distribution on a working surface of rotor-type drying devices is carried out. The orientation of the fibre significantly reduces the energy consumption of the operation of the equipment for drying, loosening and preparing the fibre for the formation of a thread.

Since the essence of cottonizing lies in the separation of the elementary fibres from each other while keeping their integrity to the highest possible degree, the key element to obtain a high cottonine quality is the weakening of the pectin-containing bonds, that is, those bonds that cause the adhesion of the elementary fibres in the fascicle as well as the adhesion of the fascicles among each other. Due to the processing of the material (in the preparatory phase of the cottonizing process) with UHF radiation between loosening the material and placing it in the aqueous medium, a preliminary weakening of the pectin-containing bonds of the fibre (up to 8-12% in flax fibre) takes place through the absorption of the UHF energy by the physically bound water, and, accordingly, the process of "microexplosions" of the water as it boils away.

Since the processing with UHF radiation is carried out in the continuous mode of subjecting the processed object to ultra-high frequency energy in a frequency range of 3 to 30 GHz, the fibre can be effectively prepared for the basic stage of cottonizing by processing the moving fibre mass (that exactly is the reason why the continuous mode is used) taking into account the efficiency of the absorption and the size of the fibre layer. For instance, a radiation with a frequency of 30 GHz is used for a layer of 8-10 mm, while 3 GHz are used for a material layer of 10-20 cm. Thus the comparability in the dimensions of the layer and the wavelength (between 8 and 10 cm) of the UHF energy are taken into account so that the optimal relation from 1:1 to 1:3 between the length of the electromagnetic wave and the dimensions of the mass of material to be processed is observed. Moreover the intensity and frequency of this processing are directly related to the efficiency of the impact time (from 10 seconds to 2 minutes, respectively, for frequencies of 30 and 3 GHz).

SHORT DESCRIPTION OF THE DRAWING

FIG. 1 shows an apparatus for the realisation of the method of the present invention in the form of a production line for cottonizing short flax fibre.

PREFERRED EXAMPLES OF REALISATION OF THE INVENTION

The method according to the present invention is explained by the example of the operation of a production line for cottonizing short flax fibre.

The production line for cottonizing consists of three basic units: Unit 1 for preliminary processing, unit 2 for shock-wave processing, and unit 3 for final processing.

Unit 1 comprises a separator 4 for stacks (not shown) of the RK-140-LP type, an inclined conveyor 5, a distribution conveyor (not shown), a feeder 6 (e.g. of the P-1 type), a supply conveyor 7 and a layer-forming hopper 8.

Unit 2 comprises a container 9 for wetting and ultrasound processing of the "water/fibre" mixture with an ultrasound source 10 for hydrodynamic processing in the continuous mode of wave impact in a range from $2\cdot10^4$ to $2\cdot10^5$ Hz (for instance in the form of an ultrasound generator of the ML 10-2.0 type with a magnetostrictive transformer), a container 11 for hydrodynamic processing of the "water/fibre" mixture in the pulsed mode by shock-wave impact with a source 12 for electropulse discharge in liquid. The source 12 comprises a electric discharge system 13 arranged in the container 11, a cable group 14 for transmission of the pulsed energy, a condenser block 15, a block 16 for high-voltage power supply, and a control processor 17.

Unit 2 with the ultrasound source 10 and a device 18 for pressing and separating the fibres from the water and the container 11 with the source 12 for electropulse discharge in liquid with a device 19 for pressing (separation of the fibres from the water) generally form a hydrodynamic processing block 20.

Unit 2 can comprise several (from one to twenty) blocks 20 (in FIG. 1 their number is three) in accordance with the required productivity.

Unit 3 comprises a container 21 for the final cleansing of erosion products from the electric discharge system 13 and orientation of the fibres with an ultrasound source 22, a supply conveyor 23, a fibre drier 24 of the centrifugal type, the inclined conveyor 7, the layer-forming hopper 8, a supply conveyor 25, a strip-forming machine 26, a final conveyor 27 and a rolling mechanism 28.

Unit 1 is connected to unit 2 by means of a fibre supply conveyor 29 with distribution devices 30 and by means of conveyors 31 for batch-wise supply of the fibre into the blocks 20. Unit 2 is connected with unit 3 by a conveyor 32 for supplying the processed fibre into the container 21.

The block 20 of unit 2 is connected by a main line 33 for supply of cleansed water to the container 9 from a centralised circulated water pooling block 34. The containers 9 and 11 are connected by main lines 35 and 36 for supply of spent water into a pooling tank 34. The container 21 is connected by a main supply line 37 with the pooling tank 34, which is connected by a main discharge line 38 with the drier 24. The containers 9 and 11 of the block 20 are connected respectively by main lines 39 and 40 for water injection via supply valves 41 and 42 of the central water supply line 43. The connections of the other blocks 20 of unit 2 with the lines 43 and the pooling block 34 are analogous and are not shown in FIG. 1.

Via an unloading conveyor 44 unit 2 is connected to the conveyor 32 for supplying the fibre to unit 3, while the container 21 is connected by a main discharge line 45 to the block 34.

The intermediate link between unit 1 and unit 2 is a UHF energy emitter 46 (for instance of the horn type), which is arranged above the batch conveyor 31.

As the UHF energy source, a standard equipment of the magnetronic type with a capacity of continuous radiation of not more than 2 kW is used.

The preliminarily prepared short flax fibre (consisting, for instance, of tows, stock elements, technical fibre Nos. 3 and 4) in standard stacks (not shown) reaches the stack separator 4 of unit 1, and after separation on splitting hackles (not shown) and loosening on a cracking drum (not shown) of the separator 4 the fibre enters the feeder 6 via the mixing conveyor 5, where a flax-fibre layer of the required thickness is formed, which by means of the supply conveyor 7 enters the layer-forming hopper 8. From the latter, the fibre is supplied to the supply conveyor 29 and via the supply device 30 the fibre is supplied batch-wise (with an overall weight of one batch from 2 to 8 kg) on batch conveyors 31, which perform the loading of the fibre into the container 9. Depending on the quality of the prepared raw material and the basic purpose of the production line with respect to the kind of cottonine to be produced (flax fibre, jute etc.) the fibre layer is processed with a UHF energy emitter 46 as it is moved to the container 9 by the conveyor 31. Usually the processing is performed with a frequency of 3 GHz (wavelength ~10 cm) for a batch layer thickness of ~20 cm. The emitter type and the corresponding dimensions of the wave guides (not shown) are chosen for one or another kind of material to be processed. If the quality of the initial fibre is good (e.g. technical fibre No. 4) the material will not be subjected to UHF processing. The water for wetting the fibre is supplied to the container 9 (at the beginning of the work on the production line) from the main line 39. Within 2-6 minutes the wetting of the fibre is performed in the container 9 while the "water/fibre" mixture is simultaneously subjected to a hydrodynamic wave field in the continuous mode from the ultrasound source 10. After this flax-fibre processing phase is completed, the water is removed (pressed out) by means of the pressing device 18 (any type), and the fibre is supplied (by any known means, for instance by means of turning over the container 9) into the container 11 for electropulse shock-wave processing. The water spent in the container 9 is supplied through the main line 35 into the pooling tank 34 for cleaning circulated water. In the container 11 a pulsed hydrodynamic processing is performed in the mode of shock-wave impact caused by the expanding vapour-gas "bubble" of the electric discharge in the space between the electrodes (not shown) of the electric discharge system 13. The pulsations of the vapour-gas bubble cause secondary shock-wave disturbances, increasing the efficiency of the processing. The electric pulse energy is supplied to the system 13 by the cable group 14 from the condenser block 15, the charge of which is performed from the high-voltage power supply block 16. The energetic level of impact on the "water/fibre" mixture is determined on the control processor 17, on which the frequency (usually from 1.5 to 3 GHz) of the delivered pulses and the charge level (usually in the range of 15 to 45 kV) are controlled. The accumulated energy of the condenser block 15 is chosen in these impact modes to be between 0.5 and 4 kJ. The efficiency of the energy generation is also chosen by varying the size of the discharge space usually from 0.5 to 5 cm. For such an amount of variation of the amplitude-frequency (and also efficiency) range of the shock-wave pulsed impact, the most effective processing (cottonizing) mode (with large efficiency and low energy consumption) can be chosen for each kind of bast-fibre material (short flax fibre, nettle, hemp, jute etc.) and these characteristics can be made to correspond to the optimal weight ratio of the "water/fibre" mixture to be processed in a range of 10:1 to 40:1, respectively.

By means of varying the size of the gap between the electrodes and the set level of the voltage, the required penetrative intensity of electric field level and the corresponding voltage level for initiating the required wavelength of the shock-wave impact in the millimeter wavelength range is obtained.

After processing in the container 11 the fibre is pressed out by means of the pressing device 19, and subsequently the processed fibre is supplied to the discharge conveyor 32 by any means, for instance, by turning the container 11 over or by means of the conveyor 44, while the spent water is supplied to the centralised circulated water pooling block 34 through the main line 35.

The operation of the other blocks 20 of unit 2 is performed analogously.

For a ramification of the fibre flows in space by the conveyors 31 and 32, the latter is arranged lower in a vertical sense than the conveyor 31. The fibre is supplied to the container 21 of unit 3 by the discharge conveyor 32. The container 21 is formed with a decreasing cross section in the direction of the drier 24 for orientation (by increasing the velocity of the flow) of the direction of placement of the fibres on the working surfaces (not shown) of the drier 24, and, correspondingly, a decrease in the probability of the occurrence of cottonizing fibre clusters. To improve the process of orientation of the fibres in one direction (along the flow) the fibre is additionally processed with an ultrasound impact from the source 22 in the container 21, while the fibre is cleansed from residues of erosion products of the elements of the electrode system 13. In the course of the first two hours of operation of the production line the ultrasound processing may not take place (due to the insignificant amount of erosion products of the elements of the electrode system 13), and also in conditions of an optimal course of the process of fibre orientation. The water in the container 21 is supplied from the pooling block 34. The used water in the container 21 returns into the pooling block 34 via the main line 38 (through the drier 24) as well as via the additional main line 45 which fulfils the function of creating the forced direction of the flow in the container 21 towards the drier 24. The fibre from the container 21 is supplied to the drier 24 by means of the supply conveyor 23, and from there into the layer-forming hopper 8 (the construction of which is analogous to the layer-forming hopper 8 of unit 1) by means of the supply conveyor 7 (the construction is also analogous to the conveyor 7 of unit 1). From the hopper 8 the fibre is supplied via the supply conveyor 25 to the strip-forming machine 26 and subsequently by means of the conveyor 27 to the rolling mechanism 28, in which rolls of cottonine strips (not shown) are formed. These rolls are the initial package of the production output flows of flax or mixed thread, the assortment and quality of which are determined by the quality of the cottonine, principally depending on the length, the linear density of the elementary fibres, and the degree of splitting in the fibre fascicle.

Industrial Applicability

The use of the method for processing bast-fibre materials according to the present invention on the basis of the entirety of electrophysical methods of impact on bast-fibre materials renders it possible to obtain high-quality cottonine with a linear density of not more than 0.3 Tex with the optimal level of energy consumption of the processing process. The cottonine obtained by this method can be used not only for high-quality flax or mixed thread but also as an ecologically clean sound-dampening material in automobiles.

The invention claimed is:

1. Method for processing bast-fibre materials comprising loosening the material, placing it in an aqueous medium, hydrodynamically processing the material and removing the latter from the aqueous medium, wherein the hydrodynamic processing of the material is performed successively in two modes: first, in a continuous mode by the impact of a hydrodynamic wave field, then in a pulsed mode by shock-wave impact, wherein the pressure amplitude of the positive wave phase in the continuous mode is smaller than the pressure amplitude of the positive wave phase in the pulsed mode.

2. Method according to claim 1 wherein the duration of the positive wave phase in the continuous mode is longer than the duration of the positive wave phase in the pulsed mode.

3. Method according to claim 1 or 2, wherein the hydrodynamic processing in the continuous mode is performed in a centimeter wavelength range, while in the pulsed mode it is performed in a millimeter wavelength range.

4. Method according to claim 1, wherein the hydrodynamic processing in the continuous mode is performed using an ultrasound source, while in the pulsed mode it is performed using a source of electropulse discharge in liquid.

5. Method according to claim 1, wherein the hydrodynamic processing in the continuous and pulsed modes is performed in different aqueous media.

6. Method according to claim 4, wherein after the hydrodynamic processing in the pulsed mode using the source of electropulse discharge in liquid, an additional processing is performed in the continuous mode using the ultrasound source.

7. Method according to claim 1, wherein the material is additionally processed with UHF radiation between loosening the material and placing it in the aqueous medium.

8. Method according to claim 7, characterised in that the processing with UHF radiation is performed in the continuous mode in a frequency range between 3 and 30 GHz.

* * * * *